United States Patent [19]

Asselin

[11] 4,046,676

[45] Sept. 6, 1977

[54] AROMATIC HYDROCARBON SEPARATION VIA SOLVENT EXTRACTION

[75] Inventor: George F. Asselin, Mount Prospect, Ill.

[73] Assignee: UOP Inc., Des Plaines, Ill.

[21] Appl. No.: 679,273

[22] Filed: Apr. 22, 1976

[51] Int. Cl.[2] ..... C10G 21/28

[52] U.S. Cl. ..... 208/321; 260/674 SE

[58] Field of Search ..... 208/321; 260/674 SE

[56] References Cited

U.S. PATENT DOCUMENTS

| | | | |
|---|---|---|---|
| 3,466,345 | 9/1969 | DeGraff et al. | 260/674 SE |
| 3,466,346 | 9/1969 | DeGraff et al. | 260/674 SE |

*Primary Examiner*—Herbert Levine

*Attorney, Agent, or Firm*—James R. Hoatson, Jr.; Robert W. Erickson; William H. Page, II

[57] ABSTRACT

A solvent extraction process for separating polar hydrocarbons from non-polar hydrocarbons. The solvent-rich extract phase from the extraction zone is introduced into a stripping column. The stripper bottoms, being a polar hydrocarbon-containing, solvent-rich stream, is introduced into an upper portion of a solvent recovery column. A first vaporous stripping medium is introduced into a lower portion of the solvent recovery column. A first solvent-rich stream, virtually free from hydrocarbons, is withdrawn as a bottoms product and recycled to the extraction zone, while a hydrocarbon-containing, side-cut second solvent-rich phase is withdrawn and introduced into the stripping column in admixture with the extract phase. At least a portion of one of the first and second solvent-rich streams is commingled with the fresh feed for introduction therewith into said extraction zone. A relatively minor proportion of the first solvent-rich stream is introduced into a solvent regenerating zone, therein contacting a second vaporous stripping medium. Regenerated solvent, containing substantially all of the second stripping medium is introduced into said recovery column as at least a portion of said first stripping medium.

8 Claims, 1 Drawing Figure

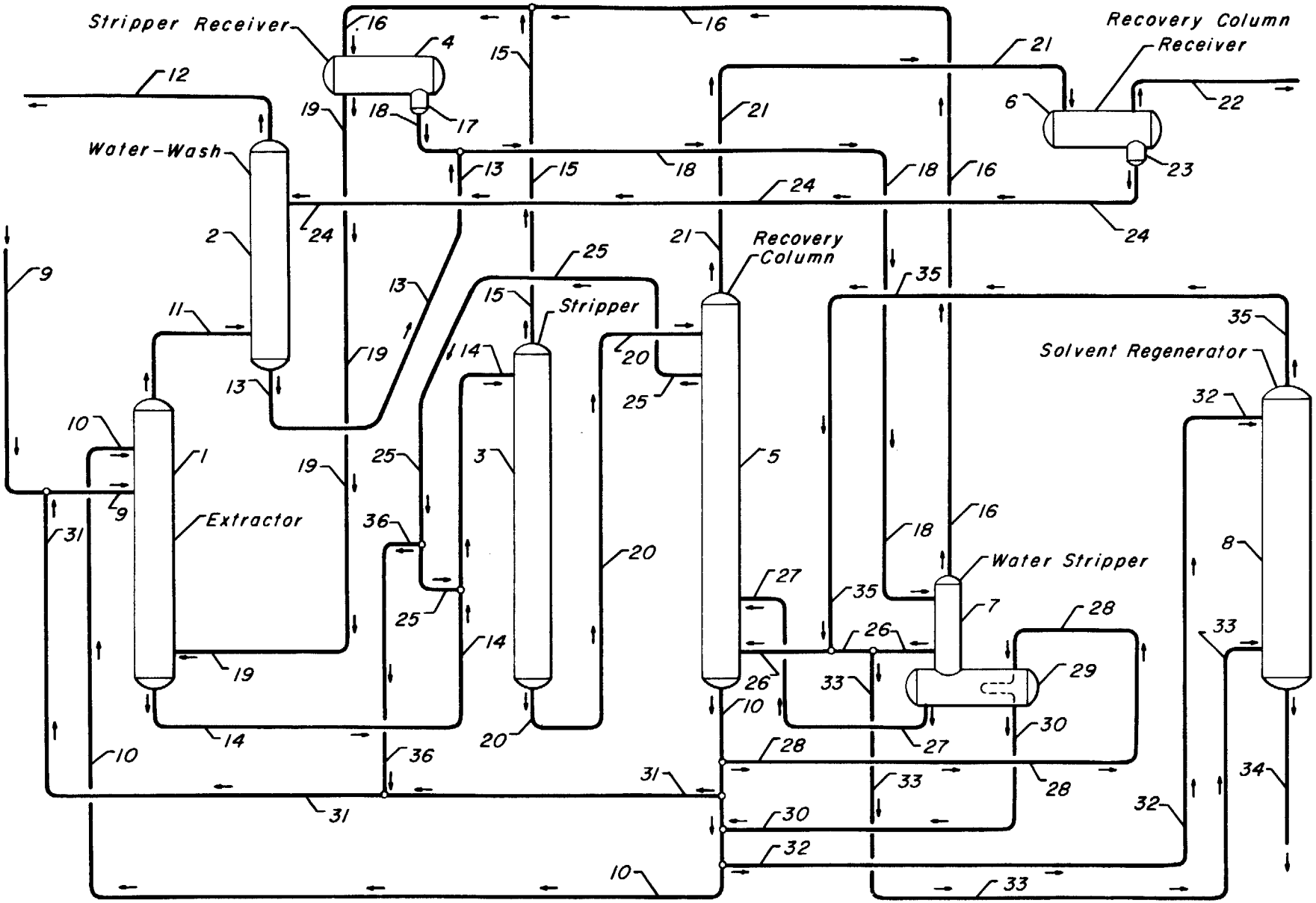
Recovery Column Receiver
Solvent Regenerator
Water Stripper
Recovery Column
Stripper
Extractor
Water-Wash
Stripper Receiver

AROMATIC HYDROCARBON SEPARATION VIA SOLVENT EXTRACTION

APPLICABILITY OF INVENTION

As herein described, the present invention is adaptable for use in the separation and ultimate recovery of polar hydrocarbons from non-polar hydrocarbons, which separation is effected through the use of a solvent characteristically selective for absorbing polar hydrocarbons. More specifically, my invention is directed toward the separation and recovery of aromatic hydrocarbons from various mixtures thereof with non-aromatic hydrocarbons. The use of the terms "polar" and "non-polar" in the present specification and appended claims, is intended to distinguish between classes of hydrocarbons wherein one particular type is more polar than the other. For example, in an extraction process intended to recover naphthenes from a mixture thereof with paraffins, the former are polar and the latter non-polar. When extracting aromatics from a mixture thereof with naphthenes, the naphthenes are considered non-polar with respect to the aromatic hydrocarbons which are polar.

In one of its specific applications, the separation process evolved from the present invention serves to segregate particular species of aromatic hydrocarbons such as benzene, toluene and/or $C_8$-aromatics from other hydrocarbons normally contained in petroleum fractions and distillates. The process utilizes a solvent which may be indefinitely recycled within the system, yields the desired product in high purity and separates the same substantially in its entirety from the feedstocks charged to the process. My invention is particularly applicable as an improvement in the type of separation process wherein a mixture of various classes of hydrocarbons is introduced into an extraction zone and is countercurrently contacted therein with a solvent selective for aromatic hydrocarbon adsorption. A raffinate phase, comprising substantially all of the non-aromatic hydrocarbons in the feedstock, is removed from one end portion of the extraction zone at which the solvent is introduced. An extract phase comprising the aromatic components of the feedstock and the selected solvent is removed from the other end portion of the extraction zone.

Although my invention is applicable for utilization with any hydrocarbon feedstock having a sufficiently high aromatic concentration to justify the recovery thereof — e.g. from about 15.0 to about 50.0% by volume — distinct advantages are afforded when processing those feedstocks having an aromatic concentration exceeding about 75.0% by volume. The feedstock will generally include, in addition to $C_6$, $C_7$ and $C_8$-aromatics, non-aromatics predominating in $C_8$ and $C_9$-paraffins and naphthenes. Exemplary of various sources of suitable charge stocks are the depentanized effluent from a catalytic reforming unit, wash oils, and especially coke oven by-products and hydrotreated pyrolysis naphthas.

Briefly, the present inventive concept involves introducing a mixture of polar hydrocarbons, non-polar hydrocarbons and the characteristically selective solvent into a first fractionation column (stripping column). The bottoms, solvent-rich polar hydrocarbon-containing stream is introduced into a second fractionating column (solvent recovery column), from which a first solvent-rich stream is withdrawn as a bottoms stream, virtually hydrocarbon free. A relatively minor proportion is introduced into the upper section of a solvent regenerator to contact, countercurrently, a vaporous stripping medium, while most of the remainder is introduced into the extraction zone for re-use in absorbing polar hydrocarbons. A second solvent-rich stream, containing hydrocarbons, is withdrawn as a side-cut stream and the greater proportion is introduced into the first fractionation column, preferably in admixture with the extract phase feed stream thereto. At least a portion of one of the first and second solvent-rich streams is introduced into the extraction column in admixture with the polar/non-polar hydrocarbon feed thereto. The portion so diverted may be derived solely from the first solvent-rich stream, in part from the first solvent-rich stream and in part from the second solvent-rich stream, or, preferably, solely from the second, side-cut solvent-rich stream. A first vaporous stripping medium is introduced into the bottom portion of the second fractionation column which permits recovery of hydrocarbon-free solvent as the bottoms stream. Solvent regeneration is accomplished through the use of a second vaporous stripping medium introduced into the lower section of the regenerator. Regenerated solvent and virtually all of the second stripping medium is introduced into the second fractionation column as at least a portion of the first vaporous stripping medium.

PRIOR ART

It must be recognized that the prior art proliferates in a wide spectrum of solvent extraction processes designed to effect the separation of aromatic hydrocarbons from a mixture thereof with non-aromatic hydrocarbons. No attempt will be made herein to delineate exhaustively the appropriate published literature; it will suffice simply to note several examples which appear exemplary of various prior art practices and procedures, and to which the present invention is applicable. The overwhelming majority of solvent extraction processes indicate a distinct preference for a water-soluble solvent comprising an oxygenated organic compound. A review of the relevant prior art indicates that the prevalent solvent is either a sulfolane-type organic compound, or an alkylene glycol, preferably a polyalkylene glycol. While most prior art processes are intended for utilization with either of the water-soluble solvents, specific techniques have been illustrated which are peculiar either to one, or the other.

The use of a light paraffin backwash stream in the solvent extraction column, to displace heavier non-aromatic components in the extract phase, is shown in U.S. Pat. No. 3,037,062 (Cl. 260-674), issued May 29, 1962. The aromatic concentrate is recovered as a side-cut from the stripping column and subsequently introduced into fractionation facilities for separation into the individual aromatic components. The rectification of a solvent-rich side-cut from the stripping zone is disclosed in U.S. Pat. No. 3,173,966 (Cl. 260-674), issued Mar. 16, 1965. This technique affords the recovery of substantially solvent-free water for subsequent utilization within the process.

U.S. Pat. No. 3,396,101 (Cl. 208-313), issued Aug. 6, 1968, involves introducing a mixture of charge stock and lean solvent into the stripping column from which a non-aromatic overhead stream is withdrawn and introduced into the extraction zone. The resulting rich solvent is passed from the extraction zone to the stripping column as a second feed stream thereto. The bottoms from the stripping column is introduced into a solvent recovery zone, the recovered solvent being withdrawn as a single bottoms stream for recycle in part to the extraction zone and in part to the stripping column.

In U.S. Pat. No. 3,436,435 (Cl. 260-674), issued Apr. 1, 1969, an aromatic side-cut is withdrawn from the stripping column, introduced into an entrainment separator from which an aromatic concentrate is subsequently transported to fractionation facilities. A solvent-containing bottoms stream is withdrawn from the entrainment separator and reintroduced into an intermediate locus of the stripping column.

Still another variation is that found in U.S. Pat. No. 3,723,256 (Cl. 203-43), issued Mar. 27, 1973. Initially, the aromatic hydrocarbon feed is introduced into a distillation column from which is recovered a light fraction and a heavier bottoms fraction. The former is passed into an extractive distillation tower while the latter is introduced into a liquid extraction unit. The extract from the liquid extraction unit is stripped of non-aromatic hydrocarbons to produce a non-aromatics free fraction and a non-aromatics containing fraction. The aromatics recovered in admixture with the solvent, from the extractive distillation column, are passed to a recovery section in admixture with the aromatic-containing fraction from the stripping zone. The overhead stream from the extractive distillation column and the non-aromatics from the stripping zone are passed in admixture to the bottom section of the solvent extraction zone, to function therein as a reflux stream.

U.S. Pat. No. 3,466,346 (Cl. 260-674), issued Sept. 9, 1969, is specifically directed toward the separation of the extract phase from the solvent extraction zone. The technique involves withdrawing, from both the extractive distillation column and the aromatic recovery distillation column, a side-cut fraction. With respect to the extractive distillation column, the side-cut fraction is introduced as a vapor directly into the aromatic recovery column. The side-cut fraction from the aromatic recovery column, being a lean solvent stream containing aromatic hydrocarbons, is returned to the extractive distillation column in admixture with the extract phase introduced thereto. It should be noted that there is no awareness respecting the introduction of a vaporous stripping medium into the lower portion of the recovery column in accordance with the method of the present invention.

The utilization of the present inventive concept significantly decreases the quantity of hydrocarbons remaining in the lean solvent stream withdrawn from the bottom of the solvent recovery column. Since this lean solvent stream is recycled to the solvent extraction zone, for re-use therein, the efficiency of separation effected therein is further enhanced. Introducing a portion of the lean solvent in admixture with the fresh feed eliminates column loading at the top of the extraction zone which otherwise results from processing high aromatic feed streams. The utilization of a second stripping medium in the solvent regenerating column, with regenerated solvent and the stripping medium being introduced into the recovery column, eliminates the overhead system normally appurtenant the regenerator.

OBJECTS AND EMBODIMENTS

A principal object of my invention is to enhance and facilitate the recovery of polar hydrocarbons from a mixture thereof with non-polar hydrocarbons. A corollary objective resides in a method for separating the polar hydrocarbons from a mixture thereof with non-polar hydrocarbons and a solvent characteristically selective for absorbing the polar hydrocarbons.

A specific object of my invention is to effect a reduction in the cost of utilities (energy savings) while separating aromatic hydrocarbons from a mixture thereof with non-aromatic hydrocarbons and the selective solvent, while simultaneously enhancing the efficiency with which aromatic hydrocarbons are originally extracted from a mixture thereof with non-aromatic hydrocarbons.

Therefore, one embodiment of the present invention is directed toward a process for the recovery of polar hydrocarbons from a mixture thereof with non-polar hydrocarbons, which process comprises the steps of: (a) introducing said polar/non-polar hydrocarbon mixture into an extraction zone, and therein countercurrently contacting said mixture with a solvent characteristically selective for absorbing polar hydrocarbons, removing a non-polar hydrocarbon raffinate stream from said zone and removing a polar hydrocarbon, solvent-rich extract phase from said zone; (b) introducing said extract phase into a stripper column, removing a non-polar hydrocarbon concentrate from said stripper column, through an upper locus thereof, and removing a solvent-rich, polar hydrocarbon concentrate through a lower locus thereof; (c) introducing said polar hydrocarbon concentrate into a recovery column, through an upper first locus thereof, introducing a first vaporous stripping medium into a lower second locus thereof, recovering a substantially solvent-free, polar hydrocarbon concentrate through an upper third locus thereof, removing a substantially hydrocarbon-free, first solvent-rich stream from a lower fourth locus thereof and removing a second solvent-rich stream, containing hydrocarbons, through a fifth locus intermediate said first and second loci; (d) introducing a portion of said first solvent-rich stream into the upper section of a solvent regenerating zone and introducing a second vaporous stripping medium into the lower section of said regenerating zone and recovering a regenerated solvent stream containing substantially all of the second vaporous stripping medium; (e) introducing said regenerated solvent stream into said recovery column as at least a portion of said first vaporous stripping medium; (f) introducing at least a portion of said second solvent-rich stream into said stripper column through an intermediate locus thereof; and, (g) introducing at least a portion of one of said first and second solvent-rich streams, with said polar/non-polar hydrocarbon mixture, into said extraction zone.

Other objects and embodiments of my invention will become evident from the following more detailed description thereof. In one such other embodiment, the volumetric ratio of the first solvent-rich stream to the solvent-rich stream, both of which are removed from the recovery column, is in the range of about 1.5:1.0 to about 4.0:1.0. In another embodiment, the portion of said first and second solvent-rich streams is about 5.0 to about 25.0% by volume of the total solvent introduced into said extraction zone.

SUMMARY OF INVENTION

As hereinbefore set forth, the technique encompassed by my inventive concept is intended for integration into a solvent extraction process for the selective separation and recovery of polar hydrocarbons from a mixture thereof with non-polar hydrocarbons. Although thus applicable to a multitude of hydrocarbon mixtures, the following discussion will be directed primarily to the separation and recovery of aromatic hydrocarbons from a mixture thereof with paraffins and/or naphthenes. Initially, the mixture of hydrocarbons is contacted with a water-soluble, oxygen-containing solvent characteristically selective for the extraction of polar hydrocarbons. As hereinbefore stated, and as hereinafter illustrated, a portion of the lean solvent, obtained from the solvent recovery column, is admixed with the hydrocarbonaceous charge stock and introduced therewith into the solvent extraction zone. The major proportion of lean solvent is introduced through a locus above that through which the feedstock is introduced. Preferably, from about 5.0 to about 25.0% (by volume) of the total solvent introduced into the extraction zone is commingled with the fresh feed stream. This technique prevents column loading in the upper regions of the extraction zone characteristically present when separating highly aromatic mixtures — e.g. at least about 75.0% by volume aromatics. There is recovered, from the solvent extraction zone, an extract phase containing aromatic hydrocarbons and a major proportion of the water-soluble solvent, and a raffinate stream containing non-aromatic hydrocarbons and a relatively minor proportion of the water-soluble solvent. The raffinate stream is generally contacted, in countercurrent flow, with water to recover the solvent and to provide a hydrocarbon concentrate which is substantially free from solvent.

The extract phase, removed from a lower portion of the solvent extraction column, is introduced into the upper portion of a stripping column, the principal function of which is to remove non-aromatic hydrocarbons in an overhead stream. Two types of columns currently in use are suitable for utilization herein: the first type is characterized by the introduction of an external vaporous stripping medium directly into the lower portion of the stripping column for the purpose of countercurrently contacting the extract phase; in the second type, the stripping column is the common reboiler type wherein the required heat-input is supplied either by the reboiling of bottoms material, with direct introduction of the reboiled stream, or through the utilization of a stab-in reboiler heater. It is understood that the precise design of the fractionating column which serves to strip the non-aromatics from the extract phase forms no essential part of the present invention. The overhead stream withdrawn from the stripping column will be a hydrocarbon concentrate containing some solvent and water. This stream is introduced into a so-called overhead stripper receiver for separation into a hydrocarbon phase and a solvent/water phase. The hydrocarbon phase, substantially free from solvent and water is introduced into the lower portion of the extraction zone as reflux, and to recover additional aromatics. The solvent/water phase is conveniently combined with the substantially hydrocarbon-free solvent/water phase from the raffinate water-wash column, the mixture being introduced into the upper portion of a water stripping column.

The solvent-rich, aromatic concentrate, substantially free from non-aromatic hydrocarbons, withdrawn from the lower portion of the stripping column, is introduced into the upper portion of a solvent recovery column. An aromatic concentrate, containing water and being substantially free from solvent, is withdrawn as an overhead stream from the solvent recovery column and introduced into an overhead receiver. The overhead receiver serves to effect a phase separation between the aromatic hydrocarbons, which are recovered, and the water phase which is introduced into the upper portion of the water-wash column for re-use in countercurrently contacting the raffinate phase therein. A first solvent-rich stream, substantially free from hydrocarbons, is withdrawn from the bottom of the solvent recovery column. The greater proportion thereof is introduced into the top of the solvent extraction zone to countercurrently contact the mixed hydrocarbon feed stream. In accordance with the present separation method, a second solvent-rich stream, containing hydrocarbons, is withdrawn from an intermediate section of the solvent recovery column and introduced into the upper portion of the stripping column, preferably in admixture with the feed thereto. As hereinafter indicated, this technique affords advantages respecting operational costs attributed to utilities. However, to ensure that this particular technique does not cause hydrocarbons to be withdrawn with the solvent-rich recovery column bottom stream, a first stripping medium is introduced into the lower portion of the solvent recovery column. A portion of the solvent recovery bottoms material is diverted and introduced into a solvent regenerating column, therein contacting a second vaporous stripping medium. Regenerated solvent, containing substantially all of the second stripping medium is introduced into the recovery column as at least a portion of said first stripping medium. Further, in accordance with the present invention, all the vaporous stripping medium is withdrawn from the lower portion of the water stripping column into which the water phase from the stripper overhead receiver and that from the water-wash column are introduced. The overhead stream from the water stripping column is introduced into the stripper overhead receiver in admixture with the overhead stream from the stripping column. In a preferred embodiment, the water stripping column is maintained at conditions of temperature and pressure which produces the vaporous stripping medium for introduction into the lower section of the solvent regenerator, as well as a liquid phase which is introduced into the recovery column through a locus intermediate that from which the solvent-rich side-cut is withdrawn and into which the vaporous stripping medium is introduced. Of the total vaporous stripping medium emanating from the water stripper column, from about 75.0 to about 100.0% is introduced into the solvent regenerator, recovered with the regenerated solvent and introduced therewith into the lower section of the solvent recovery column. The remaining portion, up to about 25.0%, is introduced directly from the water stripping column into the solvent recovery column as the first vaporous stripping medium.

The withdrawal of the hydrocarbon-containing, solvent-rich side-cut from the recovery column, reduces the load on the reboiler section thereof. The introduction of the side-cut into the upper portion of the stripping column affords better separation between aromatic and non-aromatic hydrocarbons. Furthermore, a significantly lesser quantity of steam is required for introduction into the bottom of the solvent recovery column. Therefore, with respect to utilities, energy consumption, expressed as BTU/hr., is significantly reduced. In comparison to a system which functions absent the recovery column side-cut, there is an energy savings which approximates about $1.5 \times 10^6$ BTU/hr. (0.38 kg-calories/hr.). The solvent-rich bottoms stream recycled to the extraction column is virtually completely free from hydrocarbons. Also, the introduction of regenerated solvent and the stripping medium employed in the solvent regenerator into the recovery column eliminates the overhead system otherwise required.

SOLVENTS AND OPERATING CONDITIONS

Generally accepted solvents, having solubility selectivity for aromatic hydrocarbons, are water-soluble, oxygen-containing organic compounds. In order to be effective in a system of solvent extraction, such as the process provided by the present invention, the solvent component must have a boiling point substantially greater than that of water which is added to the solvent composition for enhancing its selectivity and, in general, must also have a boiling point substantially greater than the end boiling point of the hydrocarbon feedstock. The solvent composition generally has a density greater than that of the hydrocarbon feedstock and is, accordingly, introduced into the uppermost portion of the solvent extraction zone, thereafter flowing downwardly, countercurrent to the rising hydrocarbon feedstock.

Organic compounds suitable as the solvent component may be selected from the relatively large group of compounds characterized generally as oxygen-containing compounds, particularly the aliphatic and cyclic alcohols, the glycols and glycol ethers, as well as glycol esters. The mono- and polyalkylene glycols in which the alkylene group contains from about 2 to about 4 carbon atoms, such as ethylene glycol, diethylene glycol, triethylene glycol and tetraethylene glycol, propylene glycol, dipropylene glycol, and tripropylene glycol constitute a particularly preferred class of organic solvents useful in admixture with water.

Another particularly suitable class of selected solvents are those commonly referred to as the sulfolane-type. That is, an organic compound having a five-membered ring, one atom of which is sulfur, the other four being carbon and having two oxygen atoms bonded to the sulfur atom. The four carbon atoms may be linked with hydrogen or alkyl groups. Other solvents preferably included are the sulfolenes such as 2-sulfolene or 3-sulfolene.

Preferably, the solvent contains a small amount of water dissolved therein to increase the selectivity of the solvent phase for aromatic hydrocarbons over non-aromatic hydrocarbons without substantially reducing the solubility of the solvent phase for the aromatic hydrocarbons. The presence of water in the solvent composition provides a relatively volatile material which is distilled from the fat solvent in the stripping column to vaporize the last traces of non-aromatic hydrocarbons by way of steam distillation. The solvent composition contains from about 0.3 to about 25.0% by weight of water, and preferably from about 3.0 to about 15.0% depending upon the particular solvent employed and the process conditions under which the various major vessels are operated. By including water in the solvent composition, the solubility of aromatic hydrocarbons in the solvent, although somewhat reduced in comparison with a non-aqueous solvent, greatly decreases the solubility of raffinate components in the solvent and also reduces the solubility of solvent in the raffinate stream. Although the quantity of solvent in the raffinate at any given instance is relatively small, the cumulative effect of solvent in a stream removed from the process flow and thus otherwise lost, greatly reduces the efficiency and economy of the solvent extraction process. The recovery of solvent from the raffinate stream can be accomplished efficiently by countercurrently washing the same with water in a separate washing zone from which an aqueous wash effluent is recovered containing the solvent.

The solvent extraction zone is maintained at conditions of temperature and pressure selected to maintain the solvent and hydrocarbons in liquid phase. Suitable temperatures are within the range of from about 80° F. (26.7° C.) to about 400° F. (204° C.), and preferably at an intermediate level in the range of about 150° F. (65° C.) to about 300° F. (149° C.). The extraction zone will generally function at a pressure from about atmospheric to about 400 psig. (28.22 atm.), and preferably from about 50 psig. (4.40 atm.) to about 150 psig. (11.21 atm.).

The stripping column is generally maintained at moderate pressures and sufficiently high temperatures to produce an overhead stream containing all the non-aromatic hydrocarbons. Typical pressures are in the range of about atmospheric to about 50 psig. (4.40 atm.) although the pressure at the top of the stripper is generally maintained at a level of about 5.0 psig. (1.34 atm.) to about 20.0 psig. (2.36 atm.). Suitable operating temperatures are within the range of about 225° F. (107° C.) to 400° F. (204° C.). Solvent recovery is effected at temperatures ranging from about 130° F. (54° C.) to about 375° F. (191° C.). The recovery column will function at a pressure less than 1.0 atmospheres, and generally at a level of about 80 mm. Hg., absolute (0.11 atm.) to about 700 mm. Hg., absolute (0.92 atm.).

The water-wash column, utilized to remove solvent from the non-aromatic raffinate, will function at a relatively low pressure of about 30 psig. (3.04 atm.) to about 75 psig. (6.10 atm.). Moderate temperatures are also employed, and will range from about 70° F. (21.1° C.) to about 130° F. (54° C.). The water-stripping column is maintained at temperatures in the range of about 200° F. (93° C.) to about 300° F. (149° C.), and pressures from about atmospheric to about 20 psig. (2.36 atm.).

Other operating conditions will be given in conjunction with the description of the present invention as illustrated in the accompanying drawing. Miscellaneous appurtenances, not believed required by those possessing the requisite expertise in the appropriate art, have been eliminated from the drawing. The use of details such as pumps, compressors, controls and instrumentation, heat-recovery circuits, coolers and condensers, valving, startup lines and similar hardware, etc., is well within the purview of those skilled in the art. It is understood that the illustration as presented is not intended to limit my invention beyond the scope and spirit of the appended claims. In converting to the metric system units, the numerical values have been rounded off to the second decimal place.

DESCRIPTION OF DRAWING

With specific reference now to the drawing, which presents the illustration as a simplified diagrammatic flow scheme, it will be noted that only the major vessels are shown. These are: solvent extraction zone 1; raffinate-water-wash column 2; stripping column 3 and the stripper overhead receiver 4; the solvent recovery column 5 and the recovery column overhead receiver 6; water-stripping column 7; and, solvent regenerator 8. Further description of the accompanying drawing will be made in conjunction with a commercially-scaled system designed to process approximately 6,765

Bbl/day (44.81 $M^3$/hr.) of an aromatic-rich blend of pyrolysis naphtha and coke oven light oil. The feedstock has a molecular weight of about 83.5 and contains about 88.1% by volume aromatics, 6.1% paraffins and 5.8% naphthenes.

The aromatic-rich charge stock, in an amount of about 988.86 lb-moles/hr. (449.48 kg-moles/hr.), or 6,648.15 Bbl/day (44.03 $M^3$/hr.), is introduced into extraction zone 1, via line 9, through an intermediate locus. Lean solvent, the source of which is hereafter set forth, in the amount of 479.05 lb-moles/hr. (217.75 kg-moles/hr.) is commingled with the feedstock via line 31. In an operating commercial system, a plurality of feed loci is provided to afford flexibility in adjusting for changes in feed rate and aromatic/non-aromatic feed ratios. For example, in an extraction zone having 95 decks, or trays, the feed loci may be at trays 42, 54 and 66, with the solvent introduced above tray 1 at the top of the zone. Solvent, in this case an aqueous solution of sulfolane, is introduced through an upper locus, via line 10 in the amount of about 3,513.04 lb-moles/hr. (1,596.84 kg-moles/hr.). The overall solvent/hydrocarbon volumetric ratio approximates 3.8:1.0, and about 88.0% of the total solvent to the extraction zone enters via line 10. Extractor 1 is maintained at a top temperature of about 210° F. (99° C.), a top pressure of about 75 psig. (6.10 atm.), a bottom temperature of 183° F. (85° C.) and a bottom pressure of about 115 psig. (8.83 atm.). A bottoms reflux stream, from line 19, the source of which is hereinafter set forth, is introduced at a temperature of about 115° F. (46° C.), in the amount of about 853.57 lb-moles/hr. (387.99 kg-moles/hr.).

A non-aromatic raffinate stream, in the amount of about 102.51 lb-moles/hr. (46.60 kg-moles/hr.), is withdrawn as an overhead stream from extractor 1, condensed and introduced, via line 11, into water-wash column 2, at a temperature of about 100° F. (37.8° C.) and a pressure of about 60 psig. (5.08 atm.). A solvent-rich aromatic concentrate, in the amount of about 5,742.01 lb-moles/hr. (2,610 kg-moles/hr.) is withdrawn from extraction zone 1 by way of line 14. In many solvent extraction processes, a portion of the raffinate, withdrawn via line 11, is recycled, without intermediate heating or cooling, to combine with the charge stream in line 9. Since this modification is not necessary to the present invention, it has not been illustrated in the drawing. The raffinate introduced by way of line 11 is countercurrently contacted by a water stream introduced via line 24, in the amount of about 406.38 lb-moles/hr. (184.72 kg-moles/hr.). Net non-aromatic raffinate, substantially free from solvent, in the amount of 101.11 lb-moles/hr. (45.96 kg-moles/hr.), and containing a minor amount of aromatic hydrocarbons, is recovered via line 12 and transported thereby to suitable storage facilities. Water, in the amount of about 407.78 lb-moles/hr. (185.35 kg-moles/hr.), containing about 1.40 lb-moles (0.64 kg-moles) of sulfolane, is recovered through line 13.

The 5,742.01 lb-moles/hr. (2,610 kg-moles/hr.) of solvent-rich material (about 69.5% by volume sulfolane and water) in line 14, is introduced thereby into an upper locus of stripping column 3. In this illustration, stripper 3 is of the external reboiler type (not illustrated) as contrasted to that wherein a vaporous stripping medium is introduced directly into the reboiler section of the column. It functions at a top temperature of about 245° F. (118° C.) and a top pressure of about 13.0 psig. (1.88 atm.), and a bottom temperature of 335° F. (168° C.) and a bottom pressure of 18.0 psig. (2,22 atm.). Also introduced into stripping column 3, preferably in admixture with the feed stream in line 14, is a solvent-rich stream from line 25, 1,882.54 lb-moles/hr. (855.70 kg-moles/hr.), which has been withdrawn as a side-cut from solvent recovery column 5. The stream in line 25 comprises about 72.46 lb-moles/hr. (32.94 kg-moles/hr.) of water, 1,800.72 lb-moles/hr. (818.51 kg-moles/hr.) of sulfolane and about 9.36 lb-moles/hr. (4.25 kg-moles/hr.) of hydrocarbons. Stripper overhead vapor, in an amount of about 935.72 lb-moles/hr. (425.33 kg-moles/hr.), of which about 9.5% by volume is sulfolane and water, is withdrawn through line 15, condensed, and introduced by way of line 16 into stripper overhead receiver 4. Stripper bottoms, substantially free from non-aromatic hydrocarbons, are removed from stripper 3 through line 20 and introduced thereby into solvent recovery column 5 in the amount of about 6,688.83 lb-moles/hr. (3,040.38 kg-moles/hr.).

Solvent recovery column 5 is maintained at conditions of temperature and pressure sufficient to provide a substantially solvent-free aromatic overhead product in line 21. In this illustration, recovery column 5 has a top temperature of about 145° F. (63° C.), a top pressure of about 283 mm. of Hg., absolute (0.37 atm.), a bottom temperature of about 337° F. (169° C.) and a bottoms pressure of about 450 mm. of Hg., absolute (0.59 atm.). The aromatic concentrate and water in line 21 is recovered in an amount of about 1,304.13 lb-moles/hr. (592.79 kg-moles/hr.). This vaporous overhead material is condensed and introduced into recovery column receiver 6. The aromatic concentrate, in the amount of 897.75 lb-moles/hr. (408.07 kg-moles/hr.) is recovered by way of line 22 and transported thereby to suitable fractionation facilities for the recovery of individual component. Water is withdrawn through dip-leg 23, in the amount of about 406.38 lb-moles/hr. (184.72 kg-moles/hr.), and introduced, via line 24 into raffinate water-wash column 2.

Referring now to stripper overhead receiver 4, the feed thereto constitutes 65.55 lb-moles/hr. (29.80 kg-moles/hr.) of water, withdrawn as an overhead vapor in line 16 from water stripper 7, and the 935.72 lb-moles/hr. (425.33 kg-moles/hr.) of stripping column 3 overhead vapors in line 15. Receiver 4 effects a phase separation whereby the hydrocarbon portion is removed via line 19 to be introduced into extractor 1 as a bottoms reflux stream. A concentrated water stream, containing about 1.2% by volume of sulfolane, is withdrawn from dip-leg 17 through line 18, in the amount of 147.70 lb-moles/hr. (67.14 kg-moles/hr.). The water from raffinate water-wash column 2, in the amount of 407.78 lb-moles/hr. (185.35 kg-moles/hr.), is admixed therewith, via line 13, and the mixture, 555.48 lb-moles/hr. (252.49 kg-moles/hr.), continues through line 18 into an upper portion of water-stripping column 7.

Water stripper 7 functions at a top temperature of about 230° F. (110° C.), a top pressure of about 6.0 psig. (1.41 atm.), a bottom temperature of about 250° F. and a bottom pressure of about 7.0 psig. (1.48 atm.). Overhead vapors, in an amount of 65.55 lb-moles/hr. (29.80 kg-moles/hr.) are withdrawn through line 16, condensed and introduced into stripper receiver 4, in admixture with stripping column 3 overhead vapors. Heat-input to water stripper 7 is supplied by way of indirect heat-exchange with at least a portion, if not all of the lean solvent from line 10, introduced via conduit 28 into reboiler section 29 and exiting therefrom through conduit 30. Stripping vapors, in an amount of 425.65 lb-moles/hr. (193.48 kg-moles/hr.) are withdrawn through line 26. From about 75.0 to 100.0% of the stripping medium is diverted through line 33 and is introduced thereby into the lower section of solvent regenerator 8. Any remaining portion, up to about 25.0%, continues through line 26 for direct introduction into solvent recovery column 5 through a lower intermediate locus. The primary purpose of introducing stripping medium into the recovery column is to maintain the lean solvent in line 10, 3,551.08 lb-moles/hr. (1,614.13 kg-moles/hr.), virtually completely free from aromatic hydrocarbons which otherwise would be introduced into extraction zone 1 with the solvent. As little as 0.5% by volume of aromatics in this stream will have an adverse effect upon the efficiency of separation above the fresh hydrocarbon feed locus to extractor 1. Also introduced into an intermediate locus of recovery column 5 is a liquid phase from reboiler section 29, via line 27, in the amount of about 64.28 lb-moles/hr. (29.22 kg-moles/hr.).

About 2,361.59 lb-moles/hr. (1,073.45 kg-moles/hr.) of solvent, containing about 9.36 lb-moles/hr. (4.25 kg-moles/hr.) of aromatics is withdrawn as a side-cut from recovery column 5 through line 25. Of this amount, 479.05 lb-moles/hr. (217.75 kg-moles/hr.) are diverted through line 36 and line 31 for admixture with the fresh hydrocarbon feed in line 9. The remainder is introduced into admixture with the extract phase in line 14; the mixture continuing through line 14 into stripping column 3. Hydrocarbon-free solvent is recovered from recovery column 5, via line 10 in the amount of about 3,551.08 lb-moles/hr. (1,614.13 kg-moles/hr.). About 38.04 lb-moles/hr. (17.29 kg-moles/hr.) are withdrawn through line 32 and introduced thereby into the upper section of solvent regenerator 8 which functions at a top temperature of about 350° F. (177° C.) and a top pressure of about 520 mm. of Hg., absolute (0.68 atm.). Deteriorated solvent and other impurities, in the amount of 0.91 lb-moles/hr. (0.41 kg-moles/hr.), is removed from the process via line 34. Regenerated solvent and substantially all of the stripping medium from line 33 is recovered in line 35, in the amount of 462.78 lb-moles/hr. (210.35 Kg-moles/hr.), and is introduced (via line 26) into recovery column 5. Fresh, make-up solvent, to compensate for that withdrawn from the system through line 34, may be added at any convenient point. In this illustration, it will be presumed that fresh solvent is added to the regenerated solvent in line 35, such that the total quantity of stripping medium in line 26 is 463.69 lb-moles/hr. (210.77 kg-moles/hr.).

The foregoing is illustrative of the technique where 100.0% of the lean solvent in line 31 is diverted from line 25 via line 36. Where the portion of lean solvent is diverted from line 10, the quantity of stripping medium required in line 26 increase to the extent that the "energy-savings" decreases from about $1.62 \times 10^6$ BTU/hr. ($0.41 \times 10^6$ kg-calories/hr.) to about $1.43 \times 10^6$ BTU/hr. ($0.36 \times 10^6$ kg-calories/hr.). The last figure represents the savings afforded as a result of the side-cut withdrawal in line 25, rather than taking all the lean solvent, required to satisfy the design needs of extraction zone 1 and stripping column 3, from the recovery column bottoms in line 10. Those skilled in the art will recognize how this can be advantageously translated to other sections of the process. Introducing the side-cut from the recovery column into the stripper column in admixture with the feed, affords an enhancement of the non-aromatic/aromatic separation in the upper regions of the stripper. Introducing regenerated solvent and the stripping medium into the recovery column eliminates the solvent regenerator overhead system.

I claim as my invention:

1. A process for the recovery of polar hydrocarbons from a mixture thereof with non-polar hydrocarbons, which process comprises the steps of:

a. introducing said polar/non-polar hydrocarbon mixture into an extraction zone and therein countercurrently contacting said mixture with a solvent characteristically selective for absorbing polar hydrocarbons, removing a non-polar hydrocarbon raffinate stream from said zone and removing a polar hydrocarbon, solvent-rich extract phase from said zone;

b. introducing said extract phase into a stripper column, removing a non-polar hydrocarbon concentrate from said stripper column, through an upper locus thereof, and removing a solvent-rich, polar hydrocarbon concentrate through a lower locus thereof;

c. introducing said polar hydrocarbon concentrate into a recovery column, through an upper first locus thereof, introducing a first vaporous stripping medium into a lower second locus thereof, recovering a substantially solvent-free, polar hydrocarbon concentrate through an upper third locus thereof, removing a substantially hydrocarbon-free, first solvent-rich stream from a lower fourth locus thereof and removing a second solvent-rich stream, containing hydrocarbons, through a fifth locus intermediate said first and second loci;

d. introducing a portion of said first solvent-rich stream into the upper section of a solvent regenerating zone and introducing a second vaporous stripping medium into the lower section of said regenerating zone and recovering a regenerated solvent stream containing substantially all of the second vaporous stripping medium;

e. introducing said regenerated solvent stream into said recovery column as at least a portion of said first vaporous stripping medium;

f. introducing a portion of said second solvent-rich stream into said stripper column through an intermediate locus thereof; and, g. introducing another portion of said second solvent-rich stream, with said polar/non-polar hydrocarbon mixture, into said extraction zone.

2. The method of claim 1 further characterized in that the first mentioned portion of the second solvent-rich stream is introduced into said stripper column in admixture with said polar hydrocarbon, solvent-rich extract phase.

3. The method of claim 1 further characterized in that said polar hydrocarbons are aromatic and said non-polar hydrocarbons are naphthenic.

4. The method of claim 1 further characterized in that said solvent is a sulfolane-type organic compound.

5. The method of claim 1 further characterized in that said solvent is a polyalkylene glycol.

6. The process of claim 1 further characterized in that the second-mentioned portion of said second solvent-rich streams is about 5.0 to about 25.0% by volume of the total solvent introduced into said extraction zone.

7. The process of claim 1 further characterized in that the volumetric ratio of said first solvent-rich stream to said second solvent-rich stream is in the range of about 1.5:1.0 to about 4.0:1.0.

8. The process of claim 1 further characterized in that a portion of the first solvent-rich stream is introduced into said extraction zone with said polar/non-polar hydrocarbon mixture.

* * * * *